US009442458B2

(12) United States Patent
Kobayashi et al.

(10) Patent No.: US 9,442,458 B2
(45) Date of Patent: Sep. 13, 2016

(54) IMAGE FORMING APPARATUS

(71) Applicant: CANON KABUSHIKI KAISHA

(72) Inventors: Takahiro Kobayashi, Nagareyama (JP); Hiromasa Katayama, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/002,548

(22) Filed: Jan. 21, 2016

(65) Prior Publication Data

US 2016/0216684 A1 Jul. 28, 2016

(30) Foreign Application Priority Data

Jan. 22, 2015 (JP) ..... 2015-010099

(51) Int. Cl.
*G03G 15/00* (2006.01)
*G03G 21/16* (2006.01)

(52) U.S. Cl.
CPC ..... *G03G 21/1647* (2013.01)

(58) Field of Classification Search
USPC ..... 399/107, 110, 111–114, 116, 117
See application file for complete search history.

(56) References Cited

U.S. PATENT DOCUMENTS 8,290,396 B2 * 10/2012 Lee ..... G03G 21/1661 399/110
8,412,070 B2 * 4/2013 Kikuchi ..... G03G 21/1821 399/110
8,478,161 B2 * 7/2013 Numata ..... G03G 21/1676 399/110
8,509,651 B2 * 8/2013 Tsukijima ..... G03G 15/0868 399/111
8,837,982 B2 9/2014 Matsuda
2014/0348540 A1 11/2014 Matsuda

FOREIGN PATENT DOCUMENTS

JP 2010-271408 A 12/2010
JP 2012-63391 A 3/2012

* cited by examiner

*Primary Examiner* — Hoan Tran
(74) *Attorney, Agent, or Firm* — Fitzpatrick, Cella, Harper & Scinto

(57) ABSTRACT

An image forming apparatus includes a mounting portion where an image forming unit, detachably mountable to the image forming apparatus, for forming an image is mounted; an inserting opening for permitting insertion of the image forming unit into the mounting portion; a cover portion for opening and closing the inserting opening; a locking portion capable of being elastically displaced between a locking position where the image forming unit is locked at an image formable mounting position and a releasing position where locking is released; and a limiting mechanism for limiting movement of the locking portion by moving to a first position where the movement of the locking portion to the releasing position is prevented when the cover portion is closed and by moving to a second position where the movement of the locking portion to the releasing position is permitted when the cover portion is opened.

10 Claims, 12 Drawing Sheets

(a) CLOSED POSITION (b) OPEN POSITION

IMAGE FORMING APPARATUS

FIELD OF THE INVENTION AND RELATED ART

The present invention relates to an image forming apparatus, such as a painter, a copying machine or a facsimile machine, for forming a character image or a pictorial image using a toner.

An image forming apparatus of an intermediary transfer type in which a plurality of image forming portions each for developing an electrostatic image formed on a photosensitive drum into a toner image by a developing device are arranged along an intermediary transfer belt has been widely used (Japanese Laid-Open Patent Application (JP-A) 2012-63391 and JP-A 2010-271408).

In JP-A 2012-63391, process cartridges in each of which the photosensitive drum and the developing device are accommodated in a single casing are arranged along the intermediary transfer belt.

In JP-A 2010-271408, drum cartridges each including the photosensitive drum accommodated in a single casing and developing cartridges each including the developing device accommodated in a single casing are alternatively arranged along the intermediary transfer belt. Here, 4 drum cartridges and 4 developing cartridges are used and are individually pulled out in a rotational axis direction of the photosensitive drum and thus are detachably mountable and exchangeable.

In the image forming apparatus from which the drum cartridges are capable of being individually pulled out in the rotational axis direction of the photosensitive drum by a manual operation, it is desirable that each of the drum cartridges can be pulled out from a main assembly casing of the image forming apparatus with light force to the possible extent. Then, when the drum cartridge is pushed and mounted in the main assembly casing of the image forming apparatus, it is desirable that a reliable mounting feeling (click feeling) is obtained at a normal mounting position while pushing in the drum cartridge with the light force.

However, when packaged shipping in which the drum cartridge detachably mountable to the main assembly casing of the image forming apparatus with the light force is shipped in a state in which the drum cartridge is mounted in the main assembly casing is made, there is a possibility that the drum cartridge moves from the normal mounting position during transportation. For that reason, in a conventional constitution, the drum cartridge is temporarily fixed to the main assembly casing of the image forming apparatus using a screw or an adhesive tape and then the packaged shipping is made.

SUMMARY OF THE INVENTION

A principal object of the present invention is to provide an image forming apparatus in which a cartridge does not readily move from a mounting position.

According to an aspect of the present invention, there is provided an image forming apparatus comprising: a mounting portion where an image forming unit, detachably mountable to the image forming apparatus, for forming an image is mounted; an inserting opening for permitting insertion of the image forming unit into the mounting portion; a cover portion for opening and closing the inserting opening; a locking portion capable of being elastically displaced between a locking position where the image forming unit is prevented at an image formable mounting position and a releasing position where locking is released; and a limiting mechanism for limiting movement of the locking portion by moving to a first position where the movement of the locking portion to the releasing position is prevented when the cover portion is closed and by moving to a second position where the movement of the locking portion to the releasing position is permitted when the cover portion is opened.

Further features of the present invention will become apparent from the following description of exemplary embodiments with reference to the attached drawings.

DESCRIPTION OF THE EMBODIMENTS

Embodiments of the present invention will be described in detail with reference to the drawings.

Embodiment 1

Image Forming Apparatus

Figure 1:
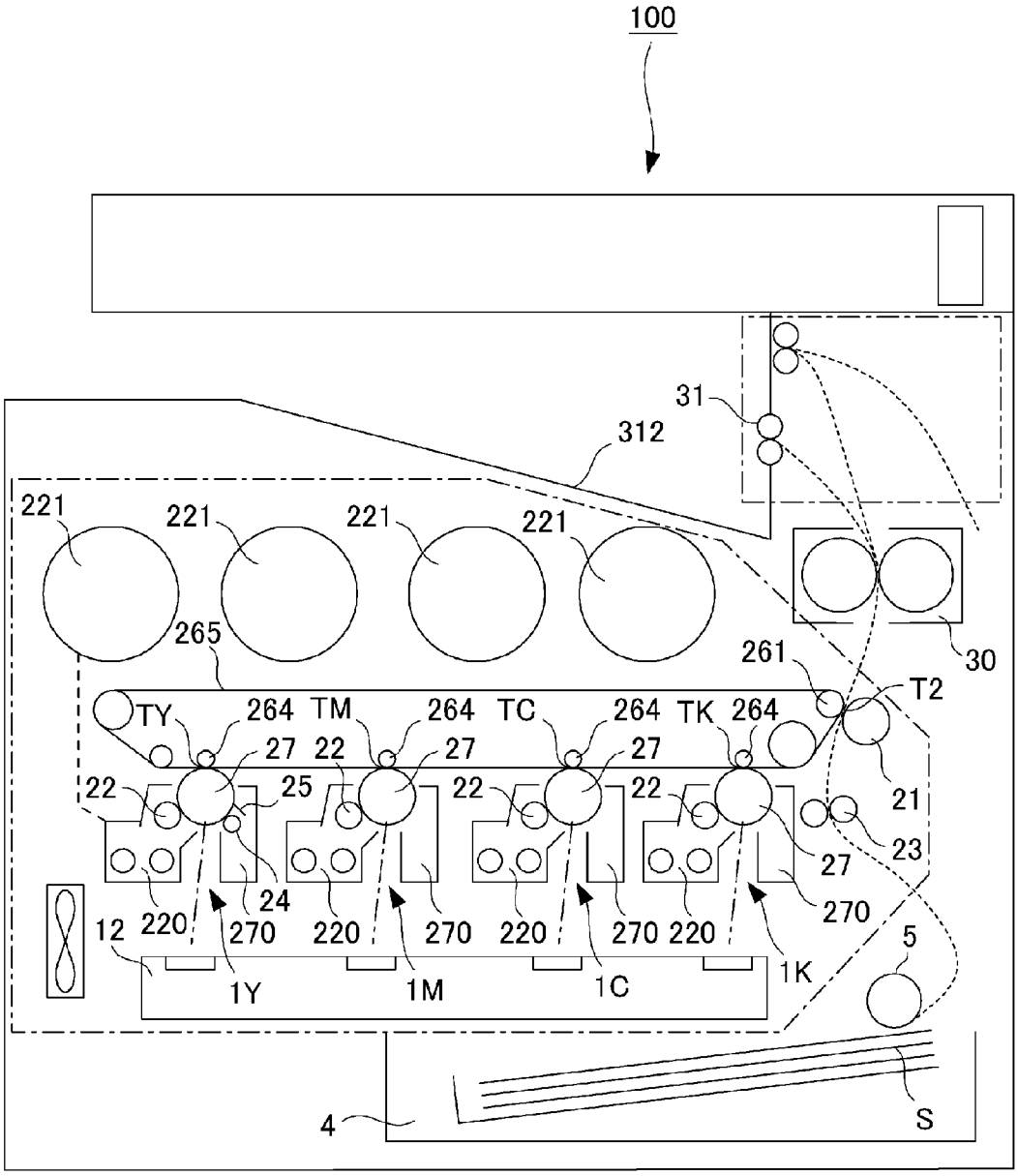
FIG. 1 is an illustration of a structure of an image forming apparatus.

FIG. 1 is an illustration of a structure of an image forming apparatus 100. As shown in FIG. 1, the image forming apparatus 100 is an intermediary transfer type full color printer of a tandem type in which image forming portions 1Y, 1M, 1C and 1K are arranged along a downward surface of an intermediary transfer belt 265.

At the image forming portion 1Y, a yellow toner image is formed on a photosensitive drum 27(Y) and then is transferred onto the intermediary transfer belt 265. At the image forming portion 1M, a magenta toner image is formed on a photosensitive drum 27(M) and then is transferred onto the intermediary transfer belt 265. At the image forming portions 1C and 1K, cyan and black toner images are formed on photosensitive drums 27(C) and 27(K), respectively, and then are transferred onto the intermediary transfer belt 265.

The four color toner images transferred on the intermediary transfer belt 265 are conveyed to a secondary transfer portion T2 and are secondary-transferred onto a recording material S. A separation roller 5 separates sheets of the recording material S, one by one, pulled out from a recording material cassette 4, and then feeds the recording material S to a registration roller pair 23. The registration roller pair 23 sends the recording material S to the secondary transfer portion T2 while being timed to the toner images on the intermediary transfer belt 265. The recording material S on which the four color toner images are secondary-transferred is pressed and heated by a fixing device 30, so that the toner images are fixed on a surface of the recording material S. Thereafter, the recording material S is discharged on a discharge tray 312 by a discharging roller pair 31. A toner cartridge 22 supplies a toner to a developing cartridge 220.

The image forming portions 1Y, 1M, 1C and 1K have the substantially same constitution except that colors of toners used in associated developing cartridges 220, respectively, are yellow, magenta, cyan and black, respectively, which are different from each other. In the following, the image forming portion 1K is described, and redundant explanation about other image forming portions 1Y, 1M and 1C will be omitted.

The image forming portion 1K includes, at a periphery of the photosensitive drum 27, a charging roller 24, an exposure device 12, the developing cartridge 220, a transfer roller 264 and a cleaning blade 25. The photosensitive drum 27 rotates at a predetermined process speed. The charging roller 24 electrically charges a surface of the photosensitive drum 27 to a negative potential uniformly. The exposure device 12 scans the surface of the photosensitive drum 27 with a laser beam, obtained by ON-OFF modulation of a scanning line image signal developed from an associated color image, through a rotating mirror, so that an electrostatic image for an image is written (formed) on the surface of the photosensitive drum 1K. The developing cartridge 220 develops the electrostatic image into a toner image by transferring the toner onto the photosensitive drum 27. The transfer roller 264 transfers the toner image from the photosensitive drum 27 onto the intermediary transfer belt 265. The cleaning blade 25 removes a transfer residual toner by sliding on the photosensitive drum 27.

(Drum Cartridge)

Figure 2:
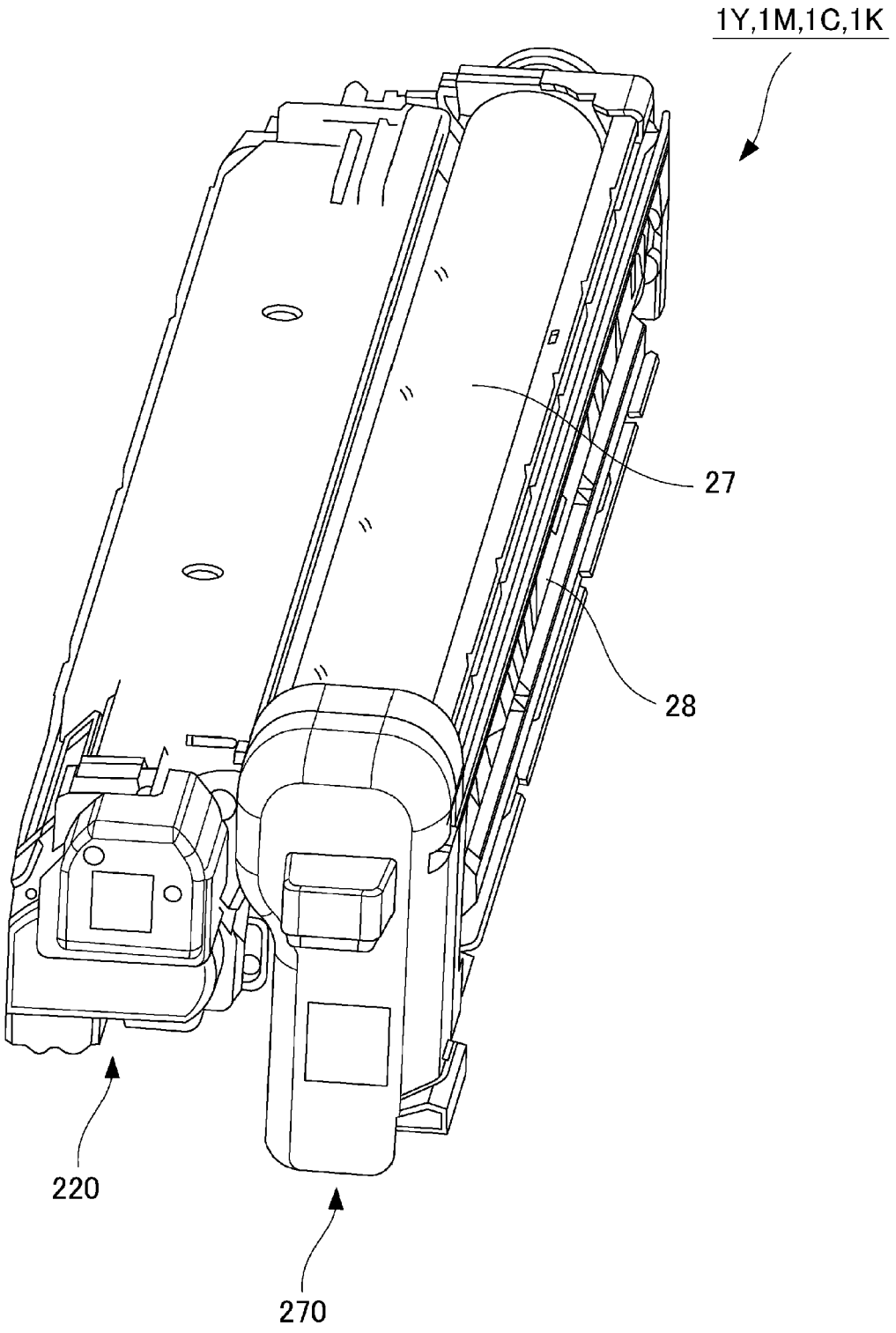
FIG. 2 is a perspective view of an outer appearance of an image forming portion.
Figure 3:
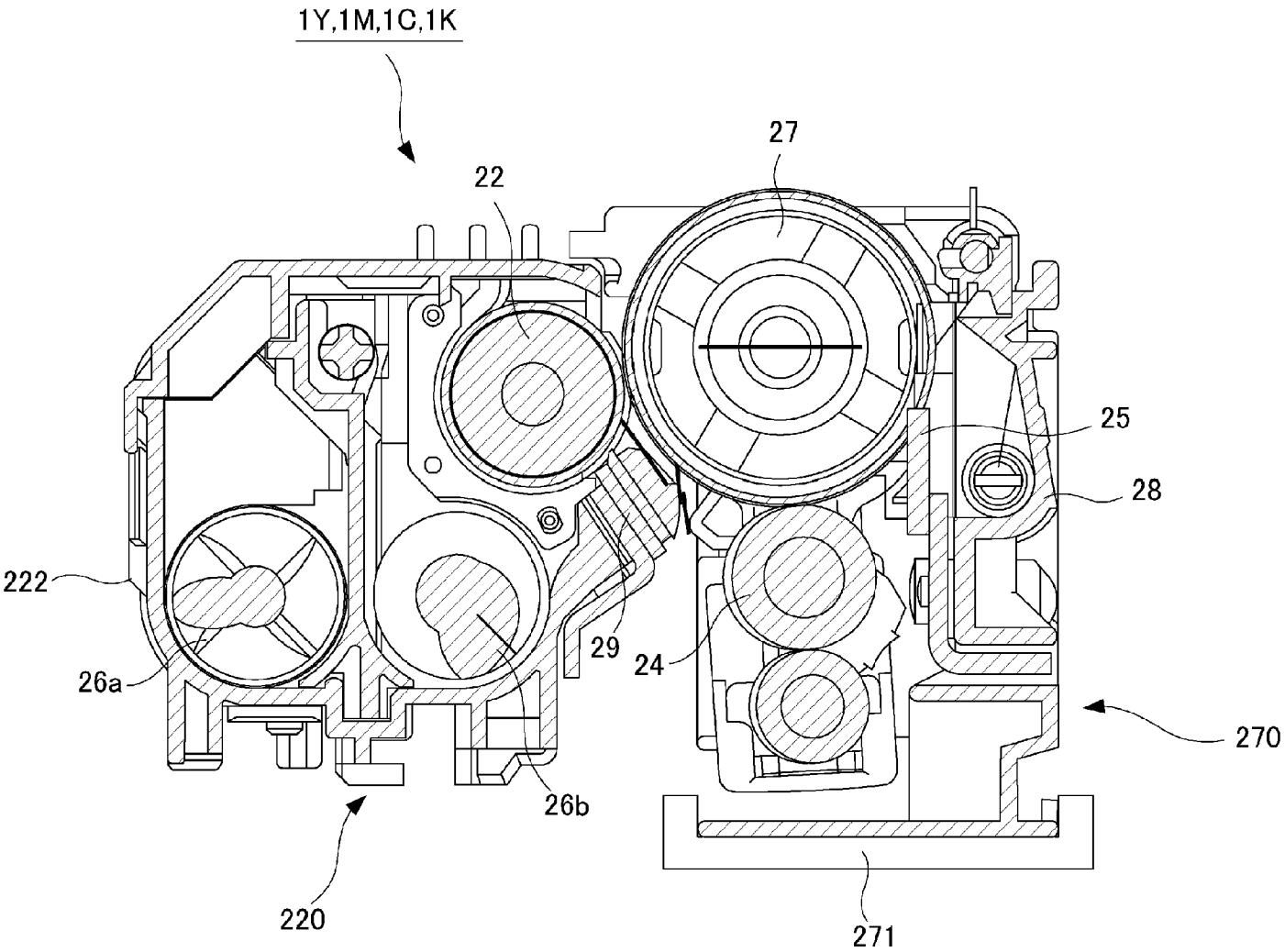
FIG. 3 is an illustration of a cross-section of the image forming portion.

FIG. 2 is a perspective view of an outer appearance of the image forming portion. FIG. 3 is an illustration of a cross-section of the image forming portion. As shown in FIG. 2, each of the image forming portions 1Y, 1M, 1C and 1K is constituted by connecting the developing cartridge 220 with a drum cartridge 270. The drum cartridge 270 and the developing cartridge 220 are individually exchangeable.

As shown in FIG. 3, the drum cartridge 270 forms an exchangeable unit in which the photosensitive drum 27, the charging roller 24 and the cleaning blade 25 are accommodated in a photosensitive drum container 28 and are integrally mounted and demounted. The photosensitive drum 27 and the charging roller 24 are secured to the photosensitive drum container 28 in a state of being pressed against the photosensitive drum 27.

The photosensitive drum 27 is drive-transmitted from a driving source (not shown) of the image forming apparatus 100 through a coupling which is provided at a rear surface and which is insertable and removable, and thus is rotated. The charging roller 24 is rotated by rotation of the photosensitive drum 27. The photosensitive drum 27, the charging roller 24 and the cleaning blade 25 are gradually lowered in performance when image formation is cumulatively effected, and therefore the drum cartridge 270 is exchanged when a degree of the lowering in these performances reaches a predetermined stage. For this reason, the drum cartridge 270 has such a constitution that the drum cartridge 270 is exchangeable by being pulled out toward a front side of the image forming apparatus 100.

The drum cartridge 270 which is an example of the cartridge includes the photosensitive drum 27 which is an example of a rotatable member rotating while carrying the toner image or the toner or which is an example of an image bearing member capable of forming the electrostatic image. A drum cartridge rail 271 which is an example of a supporting member has a mounting surface, which is an example of a surface on the supporting member, on which the drum cartridge 270 is mounted, and supports the drum cartridge 270 movably in an insertion and removing direction along a rotational axis direction of the photosensitive drum 27.

(Developing Cartridge)

As shown in FIG. 3, the developing cartridge 220 is a developing device of a two-component type using a two-component developer. Inside a developing container 222, a developing sleeve 22 for developing the electrostatic image into the toner image is provided opposed to the photosensitive drum 27 with a gap. The developing sleeve 22 rotates while carrying a magnetic chain of the toner, and develops the electrostatic image, formed on the photosensitive drum 27, at a developing position where the photosensitive drum 27 and the developing sleeve 22 oppose each other.

The developing container 222 is provided with bearings for rotatably supporting ends of feeding screws 26*a*, 26*b*. Each of the feeding screws 26*a*, 26*b* circulates and charges the developer in the developing container 222 while stirring the developer, and supplies the developer to the developing sleeve 22. The developing container 222 is provided with a developing blade 29 for regulating a layer thickness of the developer on the developing sleeve 22 at a certain level. A gap (SB gap) between the developing sleeve 22 and the developing blade 29 is precisely adjusted in a manufacturing step.

Similarly as in the case of the drum cartridge 270, the developing cartridge 220 is exchanged when a degree of a lowering in performance reaches a predetermined stage. For this reason, also the developing sleeve 22 has such a constitution that the developing sleeve 22 is exchangeable by being pulled out toward the front side of the image forming apparatus 100.

(Spacing Operation of Developing Cartridge)

Figure 4:
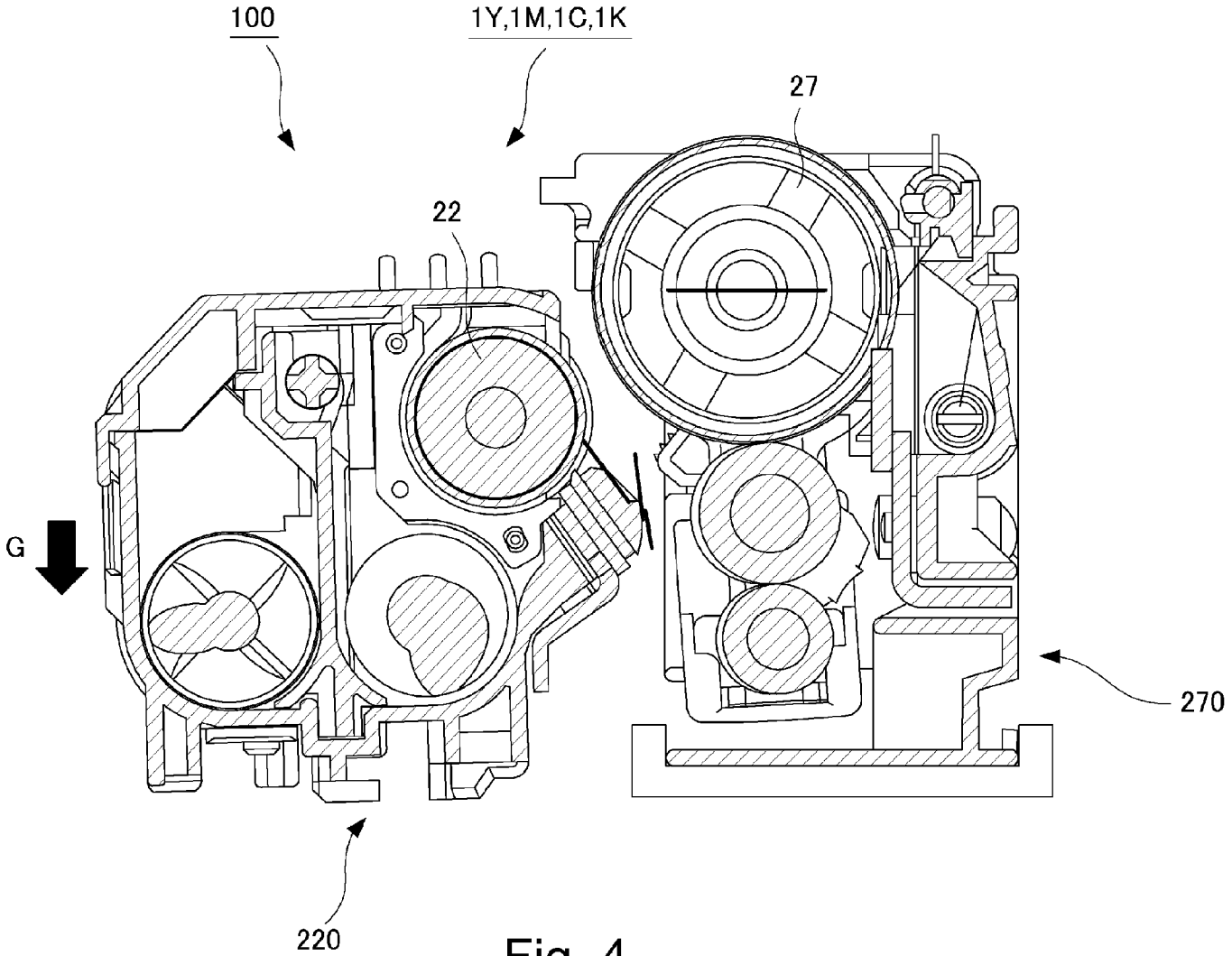
FIG. 4 is an illustration of a spacing operation before exchange (replacement) of a developing cartridge.
Figure 5:
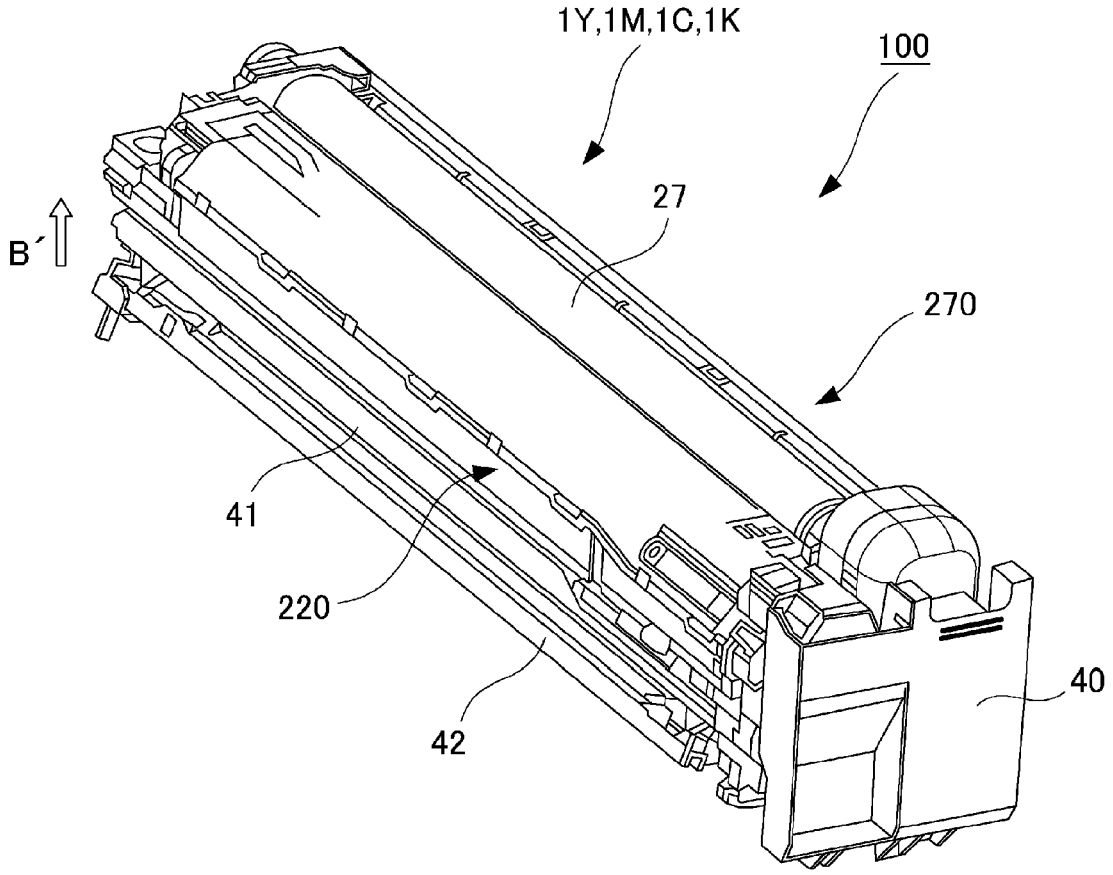
FIG. 5 is a perspective view of a state before exchange of the developing cartridge and a drum cartridge.
Figure 6:
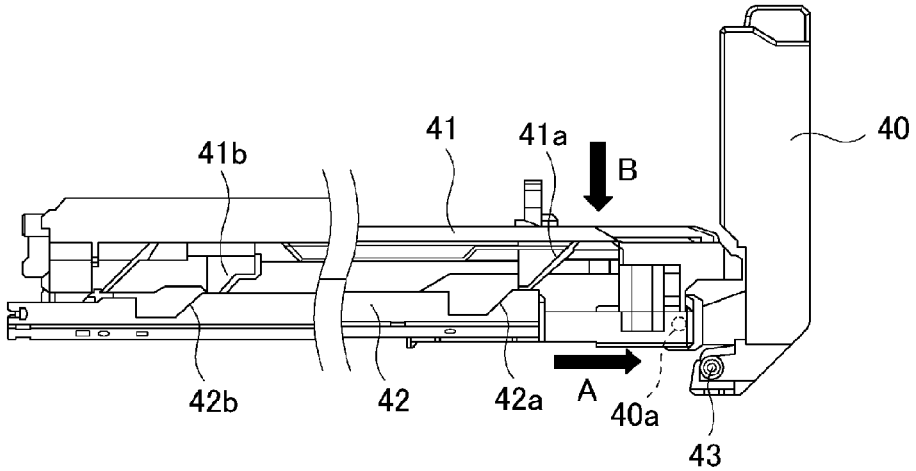
In FIG. 6, (a) and (b) are illustrations of an operation of a spacing mechanism for the developing cartridge.
Figure 6:
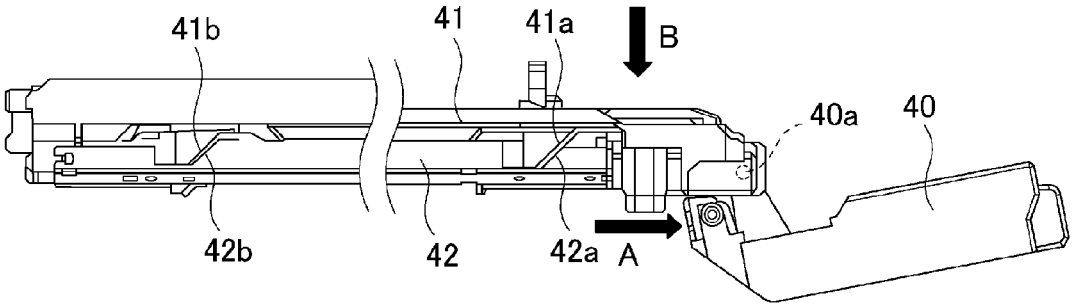
Figure 7:
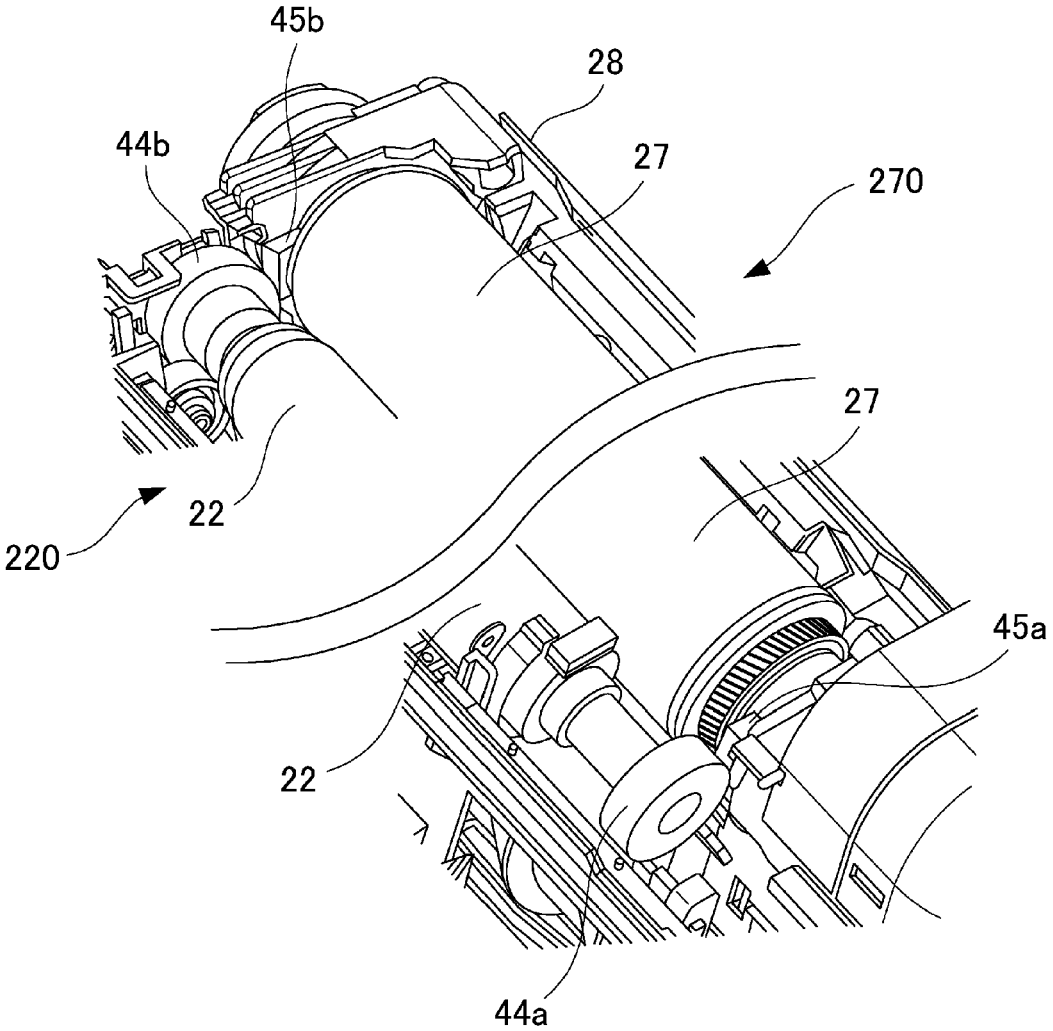
FIG. 7 is an illustration of a state in which the developing cartridge is positioned relative to the drum cartridge.

FIG. 4 is an illustration of a spacing operation before exchange (replacement) of a developing cartridge. FIG. 5 is a perspective view of a state before exchange of the developing cartridge and a drum cartridge. In FIG. 6, (a) and (b) are illustrations of an operation of a spacing mechanism for the developing cartridge. FIG. 7 is an illustration of a state in which the developing cartridge is positioned relative to the drum cartridge. In FIG. 6, (a) shows a closed state of a small door, and (b) shows an open state of the small door.

As shown in FIG. 3, in each of the image forming portions 1Y, 1M, 1C, 1K, the developing cartridge 220 and the drum cartridge 270 are disposed in a closed state. For this reason, when the developing cartridge 220 is pulled out toward the front side of the image forming apparatus 100, there is a possibility that the photosensitive drum 27 is damaged by sliding of the developing cartridge 220 on the photosensitive drum 27. Therefore, as shown in FIG. 6, in the image forming apparatus 100, in advance of the pulling-out of the developing cartridge 220, the developing cartridge 220 is moved in an arrow G direction (vertically downward) relative to the drum cartridge 270, and thus is spaced from the photosensitive drum 27.

As shown in FIG. 5, in a front side of the developing cartridge 220 and the drum cartridge 270, a small door 40, which is an example of a door member, is provided in each of the image forming portions 1Y, 1M, 1C, 1K. In a state in which the small door 40 is closed, both of the developing cartridge 220 and the drum cartridge 270 cannot be accessed. The small door 40 constitutes an operation portion not only for preventing such an erroneous operation that the developing cartridge 220 is pulled out toward the front side but also for moving the developing cartridge 220 vertically downward in interrelation with an operation by which the small door 40 itself is opened.

As shown in (a) of FIG. 6, the developing cartridge 220 is supported by a developing rail 41 so as to be pullable out toward the front side. The developing rail 41 is held at a raised position by a spacing link 42, and the spacing link 42 is mechanistically connected with the small door 40.

The small door 40 is rotatable about a rotation shaft 43. The small door 40 is fastened to the spacing link 42 by a link shaft 40*a* provided near the rotation shaft 43. At an upper surface of the spacing link 42, recessed portions 42*a*, 42*b* are provided. At a lower surface of the developing rail 41, foot portions 41*a*, 41*b* are provided.

As shown in (b) of FIG. 6, an opening operation of the small door 40 acts as a trigger for the spacing of the developing cartridge 220. When the small door 40 rotates in the clockwise direction about the rotation shaft 43, the link shaft 40*a* moves in the arrow A direction, so that the spacing link 42 is pulled out in the arrow A direction and thus the foot portions 41*a*, 41*b* engage with the recessed portions 42*a*, 42*b*, respectively. When the spacing link 42 moves in the arrow A direction, inclined surfaces of the foot portions 41*a*, 41*b* gently slide down along inclined surfaces of the recessed portions 42*a*, 42*b*, respectively, so that the developing rail 41 moves in an arrow B direction. A height of the developing rail 41 lowers, so that the developing cartridge 220 moved downward vertically. The arrow B direction in which the developing cartridge 220 moves and an amount of movement of the developing cartridge 220 correspond to a spacing direction of the developing cartridge 220 and a spacing amount of the developing cartridge 220, respectively.

As shown in (b) of FIG. 6, when the small door 40 is in an open state, the developing cartridge 220 is in a position spaced from the adjacent drum cartridge 270 as shown in FIG. 4. For this reason, the developing cartridge 220 can be removed from the image forming apparatus 100 toward the front side and can be inserted from the front side into the image forming apparatus 100 without damaging the photosensitive drum 27. When the small door 40 is in a an open state, also the drum cartridge 270 can be removed from and inserted into the image forming apparatus 100 without damaging the photosensitive drum 27.

As shown in FIG. 5, by an unshown urging means, the developing cartridge 220 is urged toward the drum cartridge 270 via the developing rail 41. As a result, as shown in FIG. 7, bearings 44*a*, 44*b* abut against bearings 45*a*, 45*b* of the photosensitive drum 27, respectively, so that a gap (SD gap) between the developing sleeve 22 and the photosensitive drum 27 is ensured. In this state, the position of the developing cartridge 220 with respect to a height direction is determined.

The developing sleeve 22 which is an example of a developer carrying member rotates while carrying the developer and develops the electrostatic image into the toner image on the photosensitive drum 27. The developing rail 41 which is an example of a retracting mechanism is capable of moving the developing cartridge 220 between a developing position where the electrostatic image can be developed into the toner image on the photosensitive drum 27 by the developing sleeve 22 and a retracted position where the developing sleeve 22 is moved from the photosensitive drum 27 in a spacing direction.

(Locking Mechanism)

Figure 8:
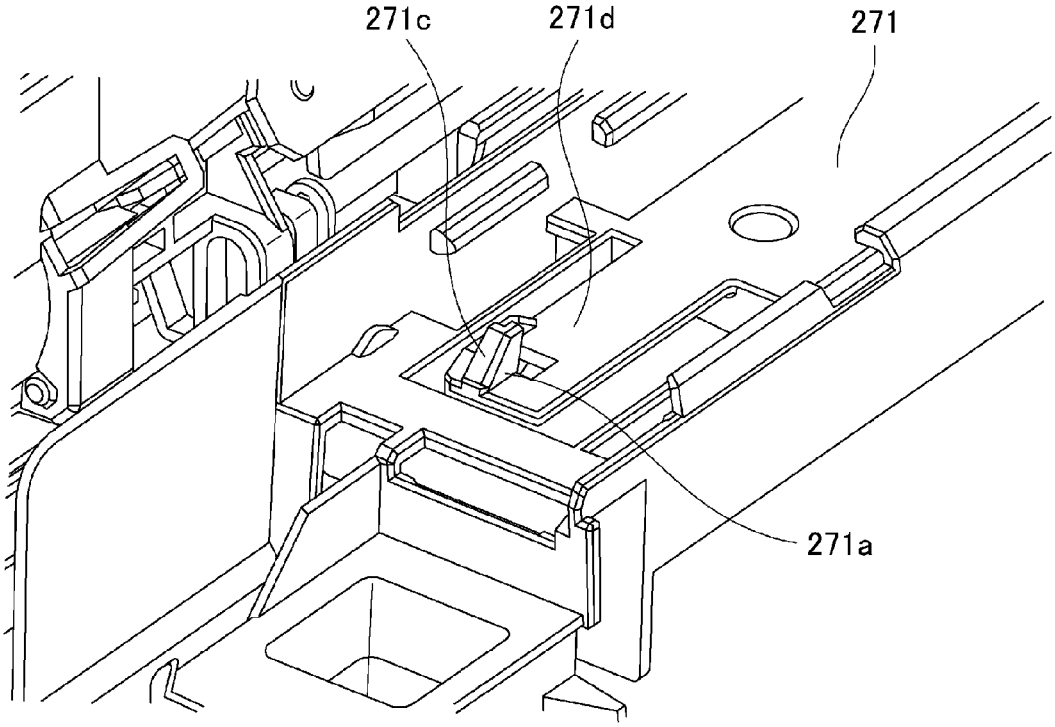
FIG. 8 is an illustration of a locking projection of a drum cartridge rail.
Figure 9:
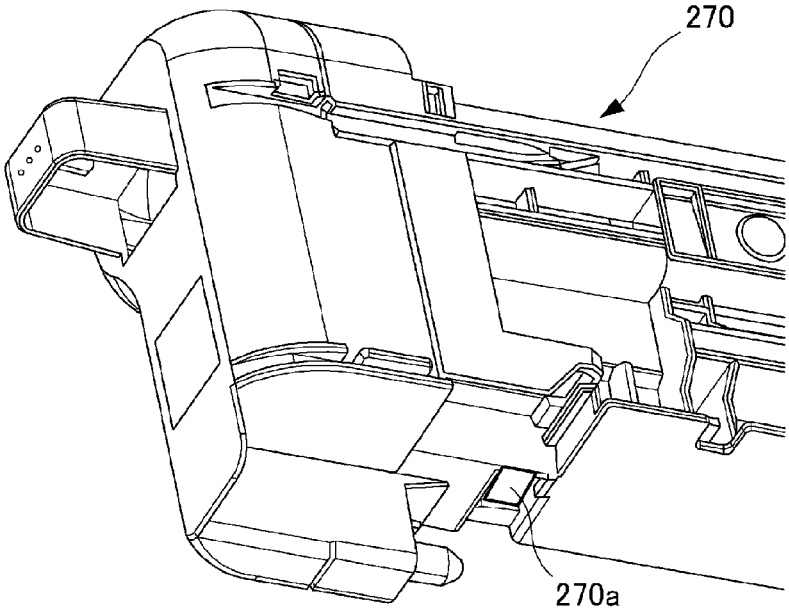
FIG. 9 is an illustration of an opening of the drum cartridge.
Figure 10:
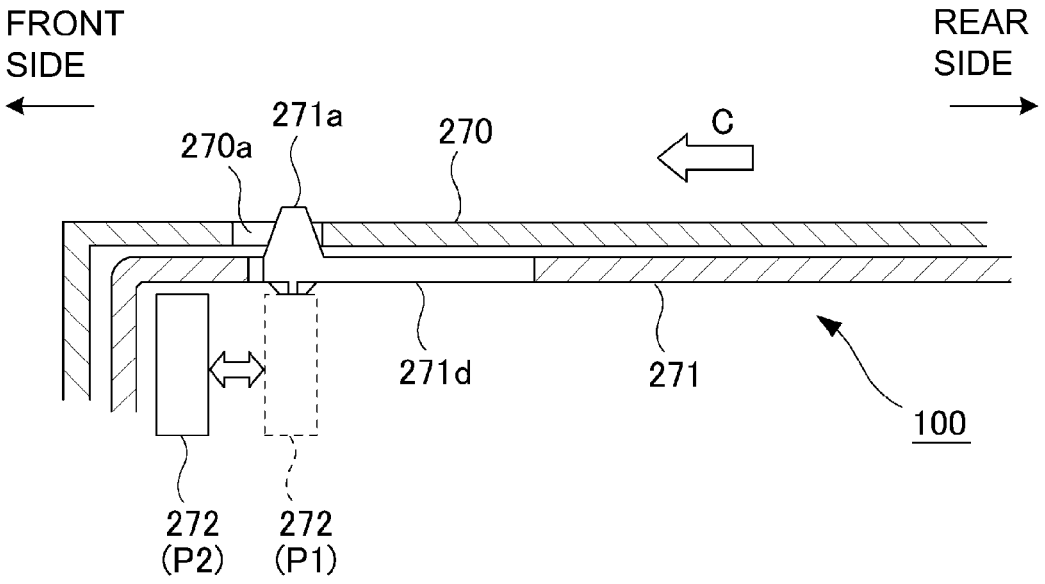
FIG. 10 is an illustration of a state in which the drum cartridge is positioned.

FIG. 8 is an illustration of a locking projection of a drum cartridge rail. FIG. 9 is an illustration of an opening of the drum cartridge. FIG. 10 is an illustration of a state in which the drum cartridge is positioned. As shown in FIG. 3, the drum cartridge 270 is guided by the drum cartridge rail 271, and is insertable from the front side toward the rear side of the image forming apparatus 100 and is removable from the rear side toward the front side of the image forming apparatus 100.

As shown in FIG. 8, the drum cartridge rail 271 is provided with a locking projection 271*a* which is an example of an engaging member for positioning and holding the drum cartridge 270. The locking projection 271*a* engages with the drum cartridge rail 271 placed in a mounting position, so that the locking projection 271*a* can be placed in a limiting state in which movement of the drum cartridge 270 in the inserting and removing direction is prevented and a non-limiting state in which the movement of the drum cartridge 270 is permitted. The locking projection 271*a* is disposed at a free end of a cantilever 271*d* formed integrally with the drum cartridge rail 271 molded with a resin material. The locking projection 271*a* has a projected shape of a snap-fit type using an elastic repelling force of the cantilever 271*d*. The locking projection 271*a* engages with an opening 20*a* which is an example of a portion-to-be-engaged of the drum cartridge 270 placed in the mounting position, so that the locking projection 271*a* holds the drum cartridge 270 at the mounting position. When the drum cartridge 270 is inserted, the locking projection 271*a* is pressed and the cantilever 271*d* is elastically deformed, so that the locking projection 271*a* is changed in state to the non-limiting state. The locking projection 271*a* moves in a vertical direction against a spring force of the cantilever 271*d* which is an example of a spring member, and thus is capable of releasing (eliminating) engagement with the opening 270*a*.

As shown in FIG. 9, the drum cartridge 270 is provided with the opening 270*a* at a position opposing the locking projection 271*a* in a state in which the drum cartridge 270 is placed at a normal mounting position.

As shown in FIG. 10, during insertion of the drum cartridge 270, the drum cartridge 270 is guided by the drum cartridge rail 271 and is inserted toward the rear side of the image forming apparatus 100. The locking projection 271*a* is retracted when the drum cartridge 270 is inserted. However, when the drum cartridge 270 is inserted and reaches a predetermined position, the locking projection 271*a* engages in the opening 270*a*, so that the drum cartridge 270 is locked and fixed at the normal mounting position.

As shown in FIG. 10, a limiting member 272 which is an example of a limiting member (means) is movable between a first position (P1) where the change in state of the locking projection 271*a* to the non-limiting state is prevented and a second position (P2) where the change in state of the locking projection 271*a* to the non-limiting state is permitted. The limiting member 272 is movable between the first position (P1) where the movement of the locking projection 271*a* in a direction of eliminating engagement with the opening 270*a* and the second position (P2) where the movement of the locking projection 271*a* is permitted.

As shown in FIG. 5, the developing cartridge 220 is, after the drum cartridge 270 is inserted into the image forming apparatus 100, raised in an arrow B' direction by closing the small door 40, and is positioned with respect to the height direction.

As shown in FIG. 9, in an inserting process of the drum cartridge 270 into the image forming apparatus 100, the drum cartridge 270 is positioned with respect to the inserting and removing direction (front-rear direction) by engagement of the locking projection 271*a* of the drum cartridge rail 271 with the opening 270*a* of the drum cartridge 270. The drum cartridge 270 is urged in an arrow C direction by an unshown urging means (an inclined surface provided in the rear side), and therefore a rear-side edge of the opening 270*a* abuts against the locking projection 271*a* (FIG. 10).

Here, a lock force of the drum cartridge 270 by the engagement between the locking projection 271*a* and the opening 270*a* is set so that an operating force when the drum cartridge 270 is pulled out is about 10-20 N. This is because when the locking force by the locking projection 271*a* and the opening 270*a* is larger than 20N, operativity during the pulling-out of the drum cartridge 270 lowers, and the drum cartridge 270 is pulled out obliquely or the like and thus an attitude of the drum cartridge 270 during the pulling-out is not readily maintained. On the other hand, when the locking force is smaller than 10N, an insertion completion operation feeding (click feeling) during the insertion of the drum cartridge 270 cannot be obtained.

(Problem of Packaged Shipping)

As shown in FIG. 5, the image forming apparatus 100 employs the cartridge type, and therefore maintenance such as exchange (replacement) of the photosensitive drum, the developing device or the like can be performed by a user himself (herself) without relying on a service person.

In the image forming apparatus 100, the developing cartridge 220 is retracted in interrelation with the opening operation of the small door 40 for integrally covering the drum cartridge 270 and the developing cartridge 220, and therefore it is possible to easily perform the maintenance such as the exchange of the photosensitive drum, the developing device or the like.

In the image forming apparatus 100, the drum cartridge rail 271 is provided with the locking projection 271*a* for effecting the positioning of the drum cartridge 270, and therefore without performing a lever operation or mounting and demounting of screws, it is possible to exchange (replace) the photosensitive drum, the developing device or the like.

However, in the image forming apparatus 100, the drum cartridge 270 is positioned on the drum cartridge rail 271 by relying on only the locking projection 271*a*, and therefore when the locking of the opening 270*a* by the locking projection 271*a* is released (eliminated), the position of the drum cartridge 270 becomes unstable. When the drum cartridge 270 is demounted toward the front side, the coupling disposed at the rear-side surface of the drum cartridge 270 is disengaged, so that a driving force is not transmitted from the image forming apparatus 100.

Incidentally, for the purpose of shortening a mounting time of the image forming apparatus 100 at an installation (shipping) destination, the image forming apparatus 100 is shipped by packing the drum cartridge 270 and the developing cartridge 220 together in an apparatus main assembly in a normal operating state. Then, at the shipping destination, without performing mounting of the drum cartridge 270 and the developing cartridge 220, actuation adjustment of the image forming apparatus 100 can be made immediately after a main switch of the image forming apparatus 100 is turned on.

In the packaged shipping, there is a possibility that the image forming apparatus 100 is subjected to application of large vibration and impact (shock) with transportation, reloading between trucks, and movement after the shipping of the image forming apparatus 100. When the large vibration and impact are applied to the image forming apparatus 100, there is a possibility that the locking of the opening 270*a* by the locking projection 271*a* is released and thus the drum cartridge 270 is positionally deviated. In the state in which the locking of the opening 270*a* by the locking projection 271*a* is released, when the image forming apparatus 100 is subjected to the vibration, there is a possibility that the photosensitive drum 27 is damaged and a quality of an output image lowers.

However, for effecting the packaged shipping, when the drum cartridge 270 and the developing cartridge 220 are temporarily fixed to the apparatus main assembly by fastening with screws or by an adhesive tape, an unpacking operation in the shipping destination is increased, as a necessary step. In addition to the locking projection 271*a*, when another new engaging mechanism or pulling-in mechanism is provided, an increase in the number of parts of the image forming apparatus 100 and upsizing of the image forming apparatus 100 are caused. As shown in FIG. 10, in the case where a thickness of the cantilever 271*d* is increased and an engaging force of the drum cartridge 270 resulting from an elastic force is increased, operativity when the drum cartridge 270 is mounted and demounted during the maintenance remarkably lowers.

Therefore, in Embodiment 1, the locking means for the drum cartridge 270 using the limiting member 272 as it is was used. The limiting member 272 for limiting elastic deformation of the locking projection 271*a* provided on the drum cartridge rail 271 in the direction of releasing the locking was provided. Further, a moving mechanism for moving the limiting member 272 between the first position (P1) and the second position (P2) in interrelation with the operation for opening and closing the small door 40 was provided.

(Moving Mechanism)

Figure 11:
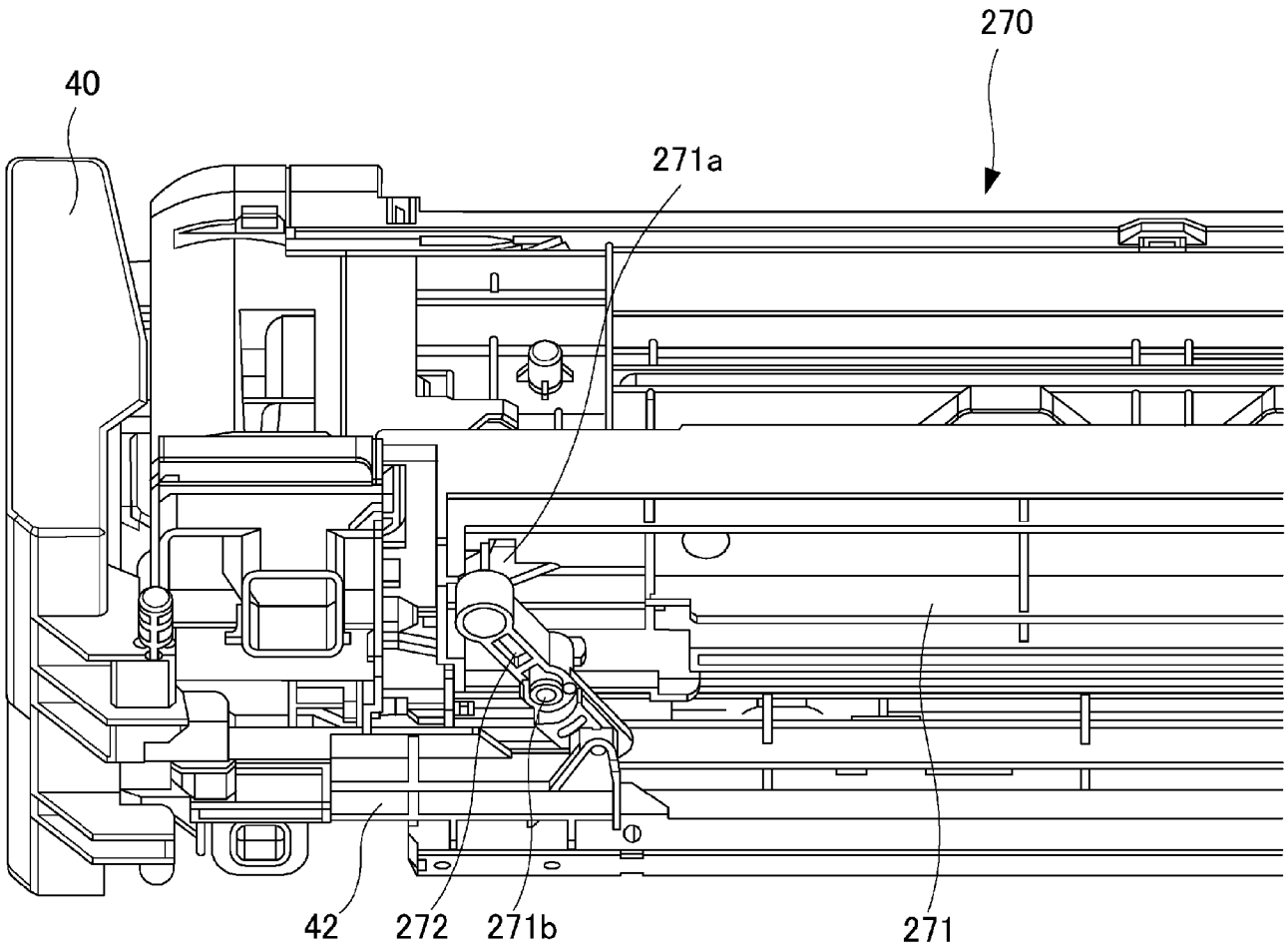
FIG. 11 is an illustration of a position of a limiting member in a state in which a small door is closed.
Figure 12:
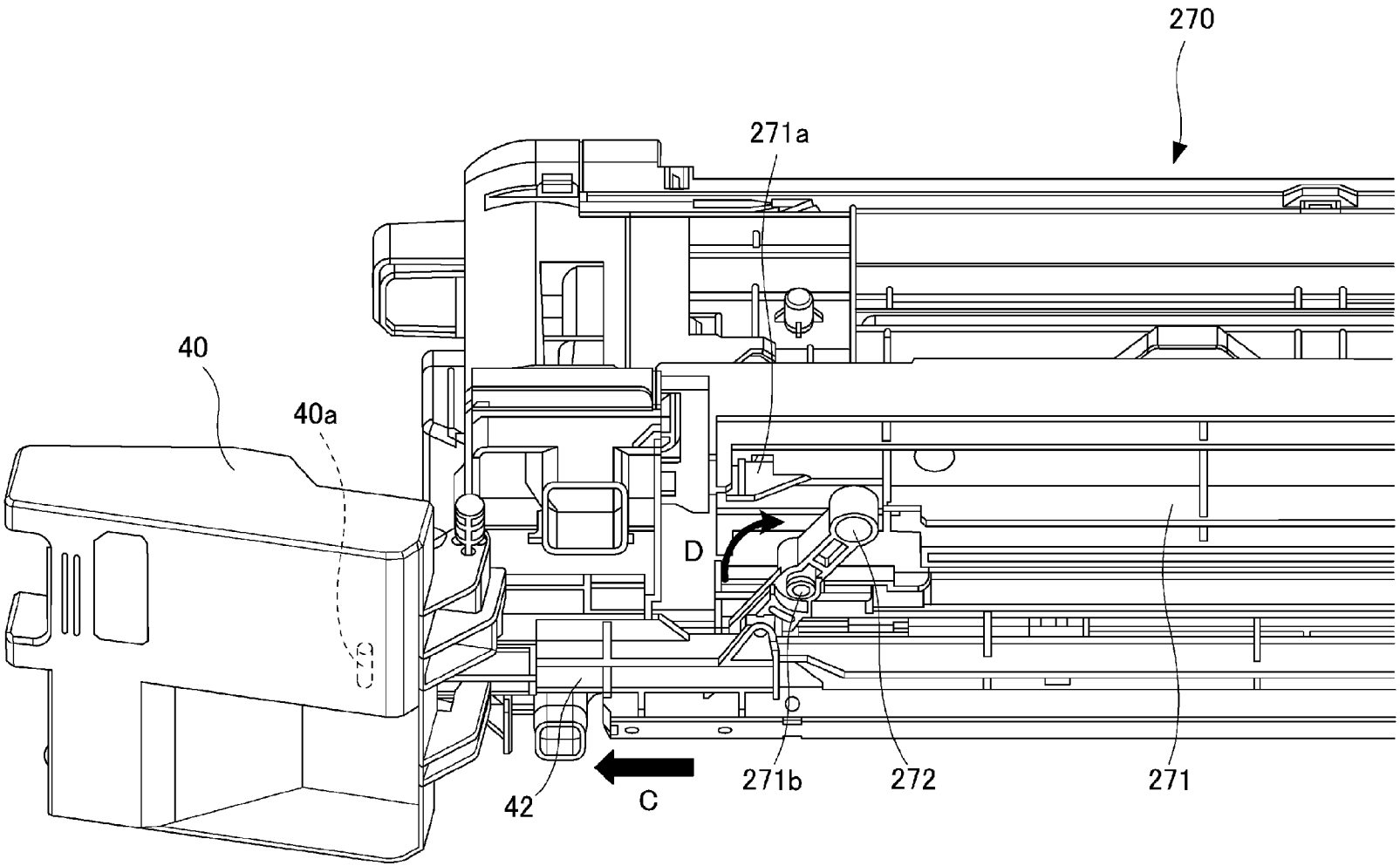
FIG. 12 is an illustration of a position of the limiting member in a state in which the small door is open.
Figure 13:
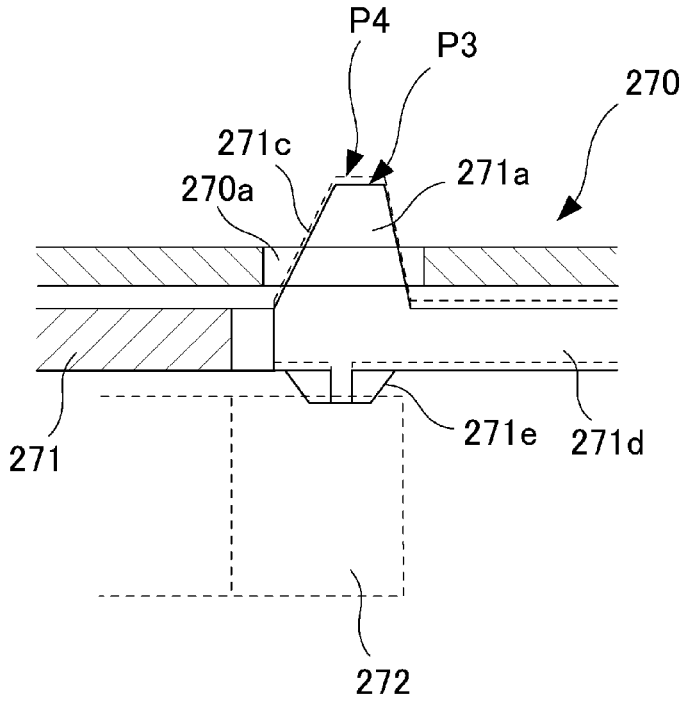
FIG. 13 is an illustration of a contact state between the limiting member and the locking projection.

FIG. 11 is an illustration of a position of a limiting member in a state in which a small door is closed. FIG. 12 is an illustration of a position of the limiting member in a state in which the small door is open. FIG. 13 is an illustration of a contact state between the limiting member and the locking projection.

As shown in FIG. 11, the limiting member 272 is rotatable about a limiting member shaft 271*b* provided at a lower surface of the drum cartridge rail 271.

The limiting member 272 is connected with the small door 40 via the spacing link 42. The limiting member 272 is driven by the spacing link 42 with the opening and closing operation of the small door 40 and thus is rotated about the limiting member shaft 271*b*.

As shown in FIG. 11, in a state in which the small door 40 is closed, the limiting member 272 is in a position contacting a lower surface of the locking projection 271*a* provided on the drum cartridge rail 271. For this reason, the locking projection 271*a* cannot release locking thereof in the opening 270*a* by downward movement thereof.

As shown in FIG. 12, when the small door 40 moves from the closed state (position) to the open state (position), the spacing link 42 is moved in the arrow C direction by being pulled by the link shaft 40*a*. By the movement of the spacing link 42, the limiting member 272 connected with the spacing link 42 rotates about the limiting member shaft 271*b* in an arrow D direction. As a result, the limiting member 272 placed in the position opposing the locking projection 271*a* provided on the drum cartridge rail 271 in the drum cartridge 270 side is retracted from the position contacting the locking projection 271*a*. As a result, the locking projection 271*a* is movable in the direction of deforming the locking in the opening 270*a*.

As shown in FIG. 13, at the lower surface of the locking projection 271*a*, an inclined surface 271*e* is formed using a rib structure obtained by resin material molding. The limiting member 272 moves toward the first position along a horizontal phantom (flat) surface and contacts the inclined surface 271*e* and then pushes up the inclined surface 271*e* by subsequent movement thereof. For this reason, when the limiting member 272 reaches the first position, the locking projection 271*a* is pushed up as a whole to a height position P4 somewhat higher than a normal engagement height position P3. Incidentally, an inclined surface having the same function as the inclined surface 271*e* may only be required to be provided on at least one of the limiting member 272 and the locking projection 271*a*.

The spacing link 42 and the small door 40 which are an example of the moving mechanism move the limiting member 272 from the second position to the first position in an interrelation with the closing operation of the small door 40 when the drum cartridge 270 is in the mounting position. The spacing link 42 moves the limiting member 272 from the first position to the second position in interrelation with the opening operation of the small door 40 and moves the limiting member 272 from the second position to the first position in interrelation with the closing operation of the small door 40.

The spacing link 42 and the small door 40 constitute a mechanism for moving the limiting member 272 by a manual operation. The spacing link 42 and the small door 40 move the limiting member 272 from the first position to the second position in interrelation with an operation for moving the developing cartridge 220 from the developing position to the retracted position. Further, the spacing link 42 and the small door 40 move the limiting member 272 from the second position to the first position in interrelation with an operation for moving the developing cartridge 220 from the retracted position to the developing position.

Effect of the Invention

In Embodiment 1, when the drum cartridge 270 is inserted to the main assembly casing of the image forming apparatus 100 and the small door 40 is in the closed state, the movement of the locking projection 271*a* for the drum cartridge 270 in a lowering direction is prevented by the limiting member 272. For this reason, during transportation, reloading and movement of the image forming apparatus 100 as a packaged shipping, even when the vibration and the impact generated and a large load with respect to the inserting and removing direction acts on the drum cartridge 270, the locking projection 271*a* is not disengaged from the opening 270*a*. The drum cartridge 270 is held while being positioned on the drum cartridge rail 271, so that sliding scars are not generated on the photosensitive drum 27. In Embodiment 1, it is possible to suppress backlash of the drum cartridge 270 in the image forming apparatus 100 without lowering the operativity of the drum cartridge 270.

In Embodiment 1, when the small door 40 is opened, the limiting member 272 is retracted and does not prevent the lowering of the locking projection 271*a*, and therefore the drum cartridge 270 can be pulled out. As shown in FIG. 10, in response to the insertion and removal of the drum cartridge 270, the cantilever 271*d* is elastically deformed, so that the locking projection 271*a* moves upward and downward. As a result, the insertion and removal of the drum cartridge 270 can be performed with light force, and the drum cartridge 270 can be positioned on the drum cartridge rail 271 easily and reliably.

In Embodiment 1, the limiting member 272 is supported movably in a direction along a phantom plane (drum cartridge 270 mounting surface of the drum cartridge rail 271) parallel to the inserting and removing direction of the drum cartridge 270. For this reason, a height of an interference space of the limiting member 272 is decreased, so that upsizing of the mechanism can be avoided. Further, the limiting member 272 rotates about the rotation shaft crossing the phantom plane parallel to the inserting and removing direction. For this reason, the locking projection 271*a* can be supported with high rigidity.

In Embodiment 1, a part of the drum cartridge rail 271 molded with the resin material is molded in a cantilever 271*d* shape, so that bending elasticity is imparted to the locking projection 271*a*. For this reason, there is no need to use a spring member as an independent urging means.

Embodiment 2

Figure 14:
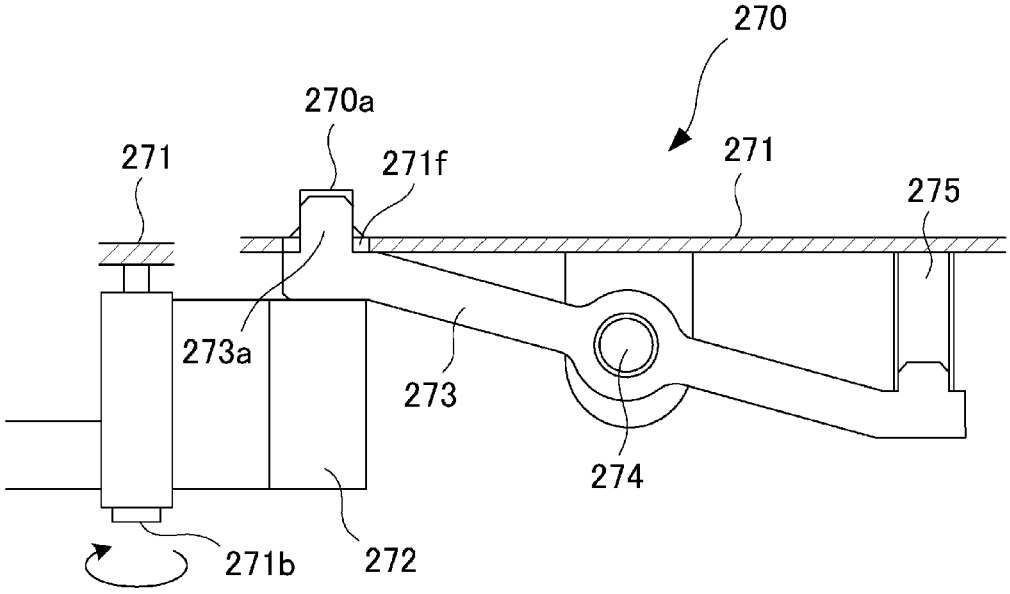
FIG. 14 is an illustration of a drum cartridge positioning mechanism in Embodiment 2.

FIG. 14 is an illustration of a drum cartridge positioning mechanism in Embodiment 2.

As shown in FIG. 10, in Embodiment 1, a part of the drum cartridge rail was cut away and thus the cantilever 271*d* was formed, so that the locking projection 271*a* was urged upward. On the other hand, in this embodiment, as shown in FIG. 14, a locking projection 273*a* was urged upward by a coil spring 275. Embodiment 2 is different in locking method of the drum cartridge 270 from Embodiment 1.

In this embodiment, the image forming apparatus 100, the drum cartridge 270, the developing cartridge 220, the limiting member 272 and the constitution for moving the limiting member 272 in interrelation with the small door 40 are the same as those in Embodiment 1, and therefore redundant description will be omitted.

(Locking Mechanism)

As shown in FIG. 14, at a lower surface of the drum cartridge rail 271, an arm member 273 rotatable about a rotation shaft 274 is provided. The arm member 273 is provided with the locking projection 273*a* at one end portion thereof, and the coil spring 275 is provided between the other end portion of the arm member 273 and the drum cartridge rail 271. The coil spring 275 which is another example of the urging means urges the locking projection 273*a*, so that the locking projection 273*a* is projected from the mounting surface of the drum cartridge rail 271 toward the drum cartridge 270 side.

The arm member 273 is urged downward by the coil spring 275 at the other end portion thereof, so that the locking projection 273*a* is projected from a guiding surface of the drum cartridge rail 271 through an opening 271*f* of the drum cartridge rail 271. The locking projection 273*a* is pressed by the drum cartridge 270 and thus is retracted from the guiding surface of the drum cartridge rail 271 against an urging force of the coil spring 275.

During the insertion of the drum cartridge 270 by guiding the drum cartridge 270 along the drum cartridge rail 271, when the drum cartridge 270 reaches a position where the locking projection 273*a* and the opening 270*a* overlap with each other, the locking projection 273*a* raises into the opening 270*a* and locks the drum cartridge rail 271. Then, when the drum cartridge 270 is pulled out along the drum cartridge rail 271, only by pulling the drum cartridge 270 with light force of 20N, the locking projection 273*a* is disengaged with the opening 270*a* and thus the drum cartridge rail 271 is movable.

Even in such a locking method, as shown in FIG. 14, by providing the limiting member 272, retraction of the locking projection 273*a* of the arm member 273 by the pressing of the locking projection 273*a* by the drum cartridge is prevented, so that a locking force of the drum cartridge 270 is remarkably enhanced. When the image forming apparatus 100 is a packaged shipping, it is possible to avoid movement of the drum cartridge 270 in the inserting and removing direction.

Other Embodiments

With respect to dimensions, materials, shapes and relative arrangement of the constituent elements described in Embodiments 1 and 2, the scope of the present invention is not intended to be limited thereto unless otherwise particularly specified.

In Embodiments 1 and 2, the locking of the drum cartridge was described, but a similar locking mechanism can also be carried out with respect to the developing cartridge using the developer carrying member as a rotatable member. The similar locking mechanism can also be carried out with respect to other cartridges or units including a process cartridge prepared by integrally assembling the drum cartridge and the developing cartridge, an intermediary transfer unit using an intermediary transfer member as the rotatable member, and a drum cartridge prepared by integrally assembling the photosensitive drum and a cleaning means into a unit.

In the case where the drum cartridges are arranged along the intermediary transfer belt, the present invention is not limited to an embodiment in which the drum cartridges are arranged along the downward surface of the intermediary transfer belt, but may also be carried out in an embodiment in which the drum cartridges are arranged along an upward surface of the intermediary transfer belt.

The movement direction of the limiting member is not limited to the horizontal direction. The rotation may also be replaced with sliding movement. The spacing link 42 sliding and moving at the lower surface of the drum cartridge rail 271 shown in FIG. 11 is contacted to the locking projection 271*a*, so that the lowering operation of the locking projection 271*a* may also be directly limited.

In Embodiment 1, the drum cartridge rail 271 and the locking projection 271*a* are formed as the same member, but the present invention is not limited thereto.

The present invention is not limited to the embodiment in which the limiting member 272 is moved in interrelation with the operation for opening and closing the small door 40. The present invention can also be carried out in an embodiment in which the limiting member 272 is moved in interrelation with a member for physically limiting the removal of the drum cartridge 270.

For example, a lever member rotatable between a blocking position were the pulling-out of the drum cartridge 270 is blocked and a non-blocking position where the pulling-out of the drum cartridge 270 is not blocked may also be provided. At this time, the spacing link 42 moves the limiting member 272 from the first position (P1) to the second position (P2) in interrelation with an operation for rotating the lever member from the blocking position to the non-blocking position by a manual operation. Further, the spacing link 42 moves the limiting member 272 from the second position (P2) to the first position (P1) in interrelation with an operation for rotating the lever member from the non-blocking position to the blocking position by the manual operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-010099 filed on Jan. 22, 2015, which is hereby incorporated by reference herein in its entirety.

What is claimed is:

1. An image forming apparatus comprising:

a mounting portion where an image forming unit, detachably mountable to said image forming apparatus, for forming an image is mounted;

an inserting opening for permitting insertion of said image forming unit into said mounting portion;

a cover portion for opening and closing said inserting opening;

a locking portion capable of being elastically displaced between a locking position where said image forming unit is locked at an image formable mounting position and a releasing position where locking is released; and a limiting mechanism for limiting movement of said locking portion by moving to a first position where the movement of said locking portion to the releasing position is prevented when said cover portion is closed and by moving to a second position where the movement of said locking portion to the releasing position is permitted when said cover portion is opened.

2. An image forming apparatus according to claim 1, wherein said locking portion includes a supporting member which is elastically deformable and locks said image forming unit at the mounting position by engaging with a portion-to-be-engaged of said image forming unit located at the mounting position, and wherein said locking portion moves to the releasing position by being pressed by said image forming unit with movement of said image forming unit from the mounting position to elastically deform.

3. An image forming apparatus according to claim 1, wherein said locking portion includes a supporting member which is elastically deformable and holds said image forming unit at the mounting position by being urged by a spring member to engage with a portion-to-be-engaged of said image forming unit located at the mounting position, and wherein said locking portion moves to the releasing position by being pressed by said image forming unit with movement of said image forming unit from the mounting position to move against urging of the spring member.

4. An image forming apparatus according to claim 1, wherein said limiting mechanism is supported movably along a phantom plane crossing a movement direction of said locking portion.

5. An image forming apparatus according to claim 1, wherein said limiting mechanism is supported movably along a phantom plane parallel to an inserting and removing direction of said image forming unit.

6. An image forming apparatus according to claim 1, wherein said limiting mechanism is supported rotatably about a rotational axis crossing a phantom plane parallel to an inserting direction of said image forming unit into said image forming apparatus.

7. An image forming apparatus according to claim 1, wherein said limiting mechanism is supported movably along a horizontal phantom plane, and wherein at least one of said limiting mechanism and said locking portion has an inclined surface for moving said locking portion upwardly, contacting said limiting mechanism with movement of said limiting mechanism toward the first position, with subsequent movement of said limit mechanism toward the first position.

8. An image forming apparatus according to claim 1, wherein said locking portion includes a supporting member which is elastically deformable, and wherein a part of said supporting member is molded in a cantilever shape to form said locking portion.

9. An image forming apparatus according to claim 1, wherein said limiting mechanism is a mechanism to be moved by a manual operation.

10. An image forming apparatus according to claim 1, further comprising a lever member rotatable between a blocking position where removal of said image forming unit in a longitudinal direction is blocked and a non-blocking position where the removal of said image forming unit in the longitudinal direction is not blocked, wherein said limiting mechanism moves from the first position to the second position in interrelation with an operation for rotating said lever member from the blocking position to the non-blocking position and moves from the second position to the first position in interrelation with an operation for rotating said lever member from the non-blocking position to the blocking position.

* * * * *